US009879933B2

(12) United States Patent
Myers

(10) Patent No.: US 9,879,933 B2
(45) Date of Patent: Jan. 30, 2018

(54) BARREL NUT MOUNTED INTEGRAL FIREARM SOUND SUPPRESSOR

(71) Applicant: Spike's Tactical, LLC, Apopka, FL (US)

(72) Inventor: James Randy Myers, Altamonte Springs, FL (US)

(73) Assignee: Spike's Tactical, LLC, Apopka, FL (US)

( * ) Notice: Subject to any disclaimer, the term of this patent is extended or adjusted under 35 U.S.C. 154(b) by 0 days.

(21) Appl. No.: 15/243,079

(22) Filed: Aug. 22, 2016

(65) Prior Publication Data

US 2017/0191779 A1 Jul. 6, 2017

Related U.S. Application Data

(60) Provisional application No. 62/206,894, filed on Aug. 19, 2015.

(51) Int. Cl.
*F41A 21/30* (2006.01)
*F41A 21/48* (2006.01)

(52) U.S. Cl.
CPC ..... *F41A 21/30* (2013.01); *F41A 21/48* (2013.01)

(58) Field of Classification Search
CPC ..... F41A 21/30; F41A 21/28; F41A 21/325; F41A 21/34; F41A 21/48
USPC ..... 89/14.4, 14.3; 181/223; 42/1.06
See application file for complete search history.

(56) References Cited

U.S. PATENT DOCUMENTS

| | | | | |
|---|---|---|---|---|
| 8,015,908 | B2 * | 9/2011 | Kline | F41A 21/30 181/223 |
| 8,171,840 | B2 | 5/2012 | Kline et al. | |
| 8,479,632 | B2 * | 7/2013 | Kline | F41A 21/30 181/223 |
| 9,103,618 | B2 * | 8/2015 | Daniel | F41A 21/325 |
| 9,273,920 | B2 * | 3/2016 | Clarke | F41A 21/34 |
| 9,482,483 | B2 * | 11/2016 | Whelan | F41A 21/30 |
| 9,658,018 | B1 * | 5/2017 | Heckert | F41A 21/30 |
| 2011/0186377 | A1 * | 8/2011 | Kline | F41A 21/30 181/223 |
| 2015/0090105 | A1 * | 4/2015 | Pace | F41A 21/30 89/14.4 |
| 2017/0299291 | A1 * | 10/2017 | Spector | F41A 3/66 |

* cited by examiner

*Primary Examiner* — John Cooper
(74) *Attorney, Agent, or Firm* — Wood Herron & Evans LLP

(57) ABSTRACT

Disclosed is an integral firearm sound suppressor, comprising a barrel, a first tube, and interior connector, a baffle tube, and at least one baffle. The barrel has an axial bore, a chamber end, and a muzzle end. The chamber end is attachable to a receiver by the barrel nut. The first tube extends forwardly of the barrel nut to define an annular first chamber at least partially surrounding the barrel and having a closed forward end. The barrel has at least one port providing fluid communication between the bore and the first chamber. The interior connector supports the muzzle end of the barrel. The baffle tube extends forwardly of the muzzle end of the barrel and has a forward end wall defining an exit opening. The at least one baffle is positioned in the baffle tube and spaced forward of the muzzle end of the barrel.

12 Claims, 4 Drawing Sheets

BARREL NUT MOUNTED INTEGRAL FIREARM SOUND SUPPRESSOR

RELATED APPLICATIONS

This application claims priority to U.S. Provisional Patent Application No. 62/206,894, filed Aug. 19, 2015, and incorporates the same herein by reference.

FIELD OF THE INVENTION

This invention relates to an integral firearm sound suppressor, and particularly one used with an AR15-pattern upper receiver in which the barrel is mounted to the upper receiver using a barrel nut. More particularly, it relates to an integral firearm sound suppressor, especially for use with pistol caliber ammunition, in which an outer tube of the suppressor is integrally formed with the barrel nut and in which both ends of the barrel may be supported by the outer tube and in tension.

BACKGROUND OF THE INVENTION

AR15-pattern firearms, in rifle or pistol configuration, have become extraordinarily popular, in part because of how easily they may be adapted to a variety of configurations, types of actions, and barrel/caliber combinations. A sound suppressor for this type of firearm, whether muzzle-mounted or integral in design, is typically mounted on and supported by the barrel. In pistol caliber configurations, shorter barrels (under 16 inches) are often desirable for a variety of reasons. However, under current federal law, a rifle having a barrel shorter than 16 inches with an integral suppressor typically requires two National Firearms Act (NFA) tax stamps for each transfer (one for the short barrel rifle and one for the sound suppressor).

Another possible problem with combining a relatively short barrel and integral suppressor, especially in pistol caliber configurations, is that unburned powder could accumulate in the suppressor baffles.

SUMMARY OF THE INVENTION

The present invention provides an integral suppressor for use with a relatively shortened barrel, particularly but not exclusively for center fire, pistol caliber rounds that can support the barrel in tension and attach the barrel to the upper receiver with a barrel nut that is an integral part of the suppressor housing.

Disclosed is an integral firearm sound suppressor, comprising a barrel, a first tube, and interior connector, a baffle tube, and at least one baffle. The barrel has an axial bore, a chamber end, and a muzzle end. The chamber end is attachable to a receiver by the barrel nut. The first tube extends forwardly of the barrel nut to define an annular first chamber at least partially surrounding the barrel and having a closed forward end. The barrel has at least one port providing fluid communication between the bore and the first chamber. The interior connector supports the muzzle end of the barrel. The baffle tube extends forwardly of the muzzle end of the barrel and has a forward end wall defining an exit opening. The at least one baffle is positioned in the baffle tube and spaced forward of the muzzle end of the barrel.

The connector can define a forward closed end of the first annular chamber. A blast wall may be spaced forwardly from the muzzle end of the barrel and form a blast chamber.

According to one embodiment, the blast wall may include a close passageway axially aligned with the bore and spaced forwardly from the muzzle end of the barrel with a diameter providing close clearance of a projectile to be fired. The length of the close passageway may be at least 0.75 times length of projectile to be fired and may be in the range of approximately 0.75 to 2.5 times length of projectile to be fired.

The first tube may be integral with or permanently affixed to the barrel nut. The baffle tube may be integral with or permanently affixed to the first tube. Such a configuration can be used to provide an overall length of the barrel assembly that meets minimum legal requirements.

The connector can be threaded to the muzzle end of barrel and can abut an internal shoulder when assembled. This allows the barrel to be placed in tension by tightening of the connector on the muzzle end of the barrel.

The port may be positioned in a rearward portion of the first chamber. In one embodiment, there may be multiple, axially spaced apart ports. This can cause multiple interfering pressure waves to form in the first chamber when a projectile is fired and before the projectile exits either the muzzle of the barrel or before it passes completely through the close passageway.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWING

Like reference numerals are used to indicate like parts throughout the various figures of the drawings, wherein.

DETAILED DESCRIPTION OF THE INVENTION

With reference to the drawings, this section describes particular embodiments and their detailed construction and operation. Throughout the specification, reference to "one embodiment," "an embodiment", or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations may not be shown or described in detail to avoid obscuring aspects of the embodiments.

Figure 1:
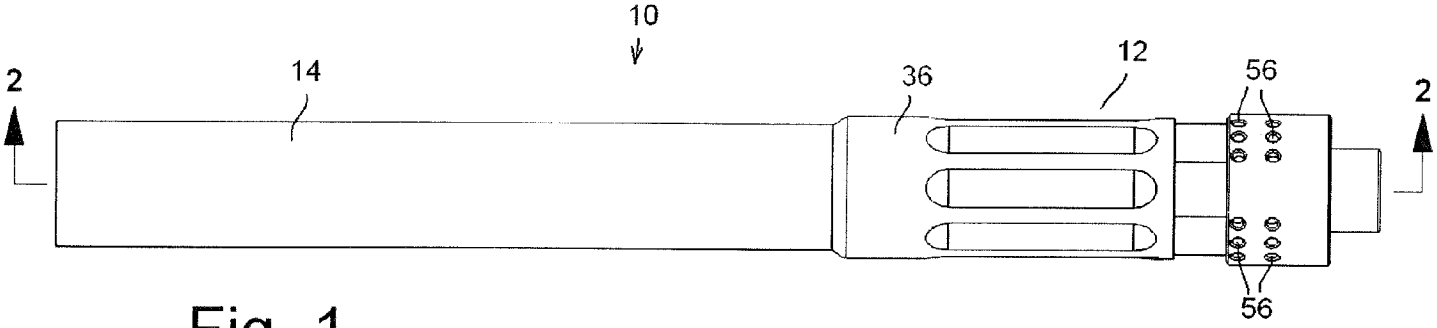
FIG. 1 is a top plan view of an integral suppressor according to one embodiment of the present invention.
Figure 2:
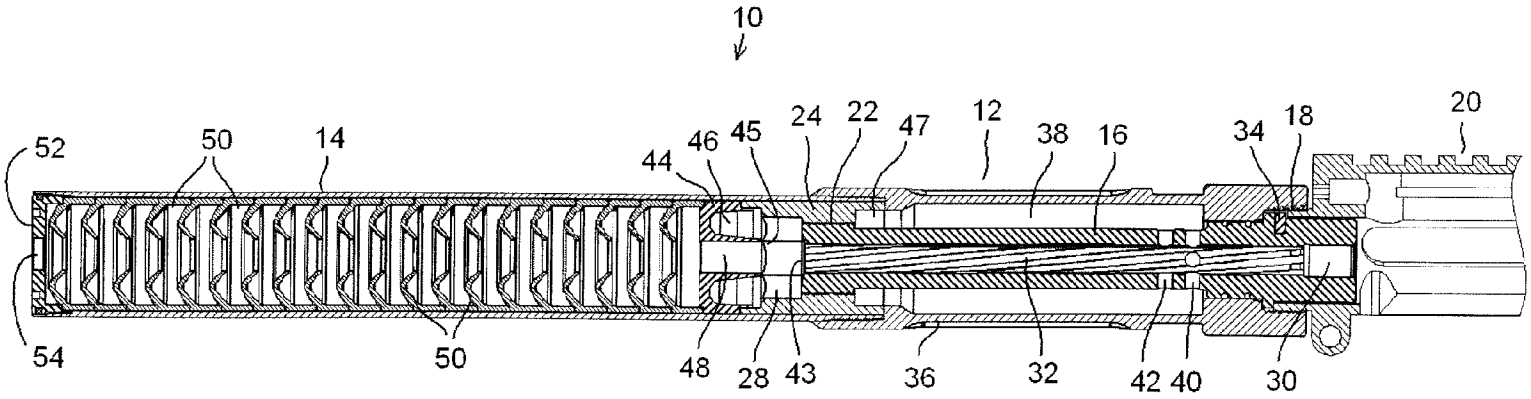
FIG. 2 is a longitudinal sectional view thereof taken substantially along line 2-2 of FIG. 1 as mounted on an upper receiver.
Figure 3:
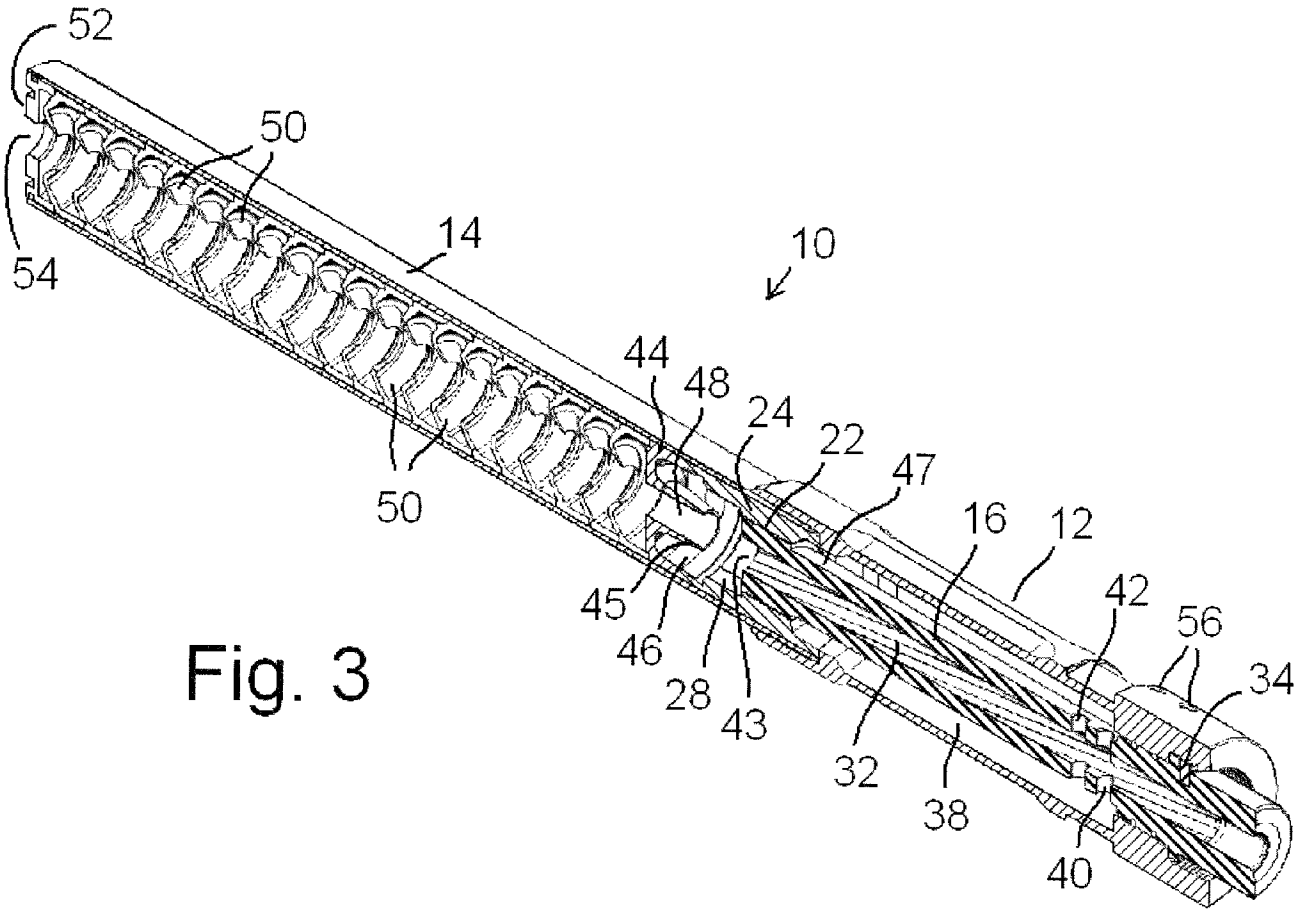
FIG. 3 is an isometric longitudinal section taken substantially along line 2-2 of FIG. 1.

Referring now to the various figures of the drawing, and first to FIGS. 1-3, therein is shown at 10 an integral, barrel-nut-mounted firearm sound suppressor according to an embodiment of the invention. An outer housing of the suppressor 10 may include a barrel nut portion 12 and a forward tube 14. The barrel nut portion 12 secures a barrel 16 to the threaded attachment 18 at a forward end of an upper receiver 20 in an otherwise well-known and ordinary manner. According to one aspect of the present invention, when the barrel 16 is less than sixteen inches in length and is to be configured as a rifle, the barrel nut portion 12 and forward tube 14 may be integrally formed or otherwise permanently fixed together, together creating an extension greater than sixteen inches in length and that is essential to assembly of the barrel 16 to the receiver 20. In this manner, when assembled as a rifle, it will not be considered a "short barreled rifle" (SBR), which is currently regulated under the National Firearms Act (NFA) separate from sound suppressors, thus otherwise requiring payment for two transfer tax stamps.

According to one embodiment, the barrel 16 may be externally threaded 22 at a forward end thereof. An interior connector or coupling nut 24 may be sized to be slidably received within the forward tube 14, to have internal threads that mate with the threaded forward portion 22 of the barrel 16, and to bear against an internal annular shoulder 26 of the barrel nut portion 12. The coupling nut 24 can be rotated within the forward tube 14, such as with a non-round tool socket 28, thereby applying longitudinal tension to the mounted barrel 16. In this manner, rather than having a barrel support a sound suppressor, as is the usual case, the barrel 16 of the present invention is attached to the receiver 20 and supported by the external body of the sound suppressor 10. Perfect alignment between the barrel and suppressor can be maintained, as well, because part of the suppressor housing is supporting and controlling both ends of the barrel 16.

Figure 4:
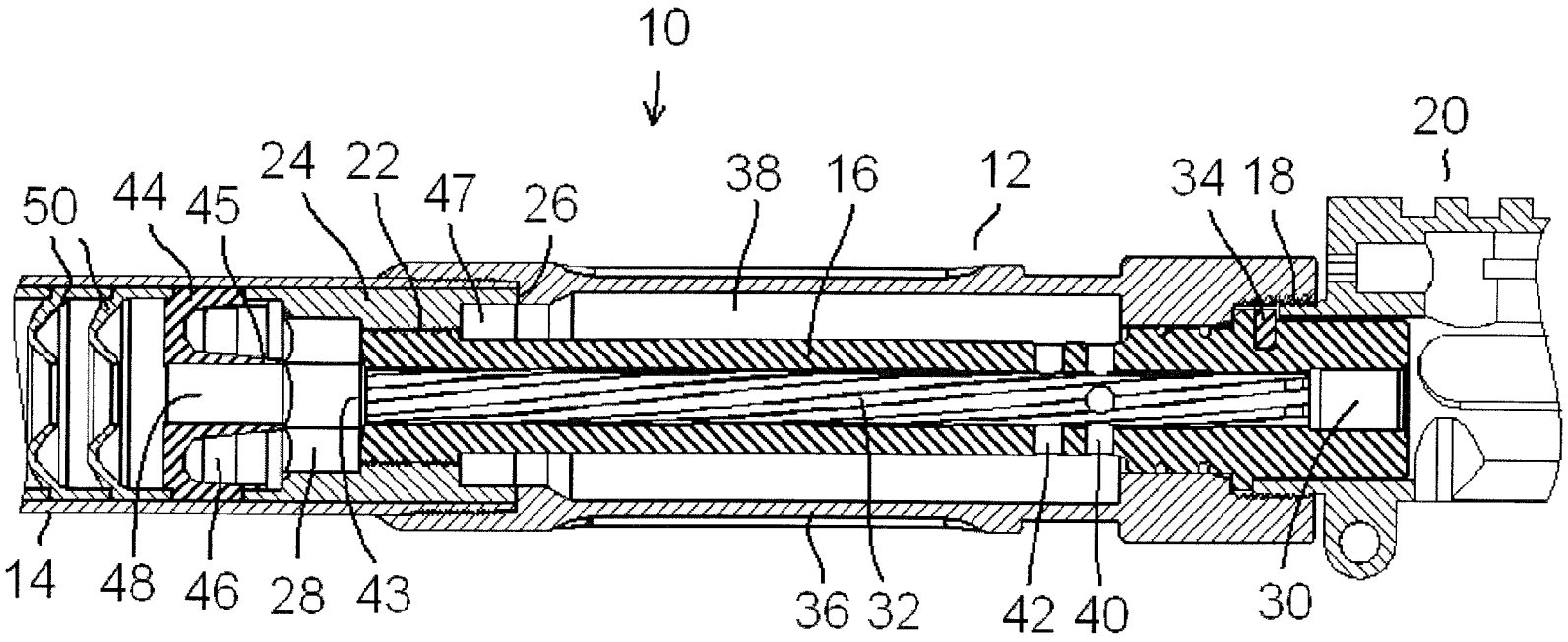
FIG. 4 is a fragmentary longitudinal sectional view enlarged to illustrate the primary chamber surrounding the barrel.

Referring now in particular to FIG. 4, it can be seen that the barrel 16 includes a chamber 30 sized to receive an ammunition cartridge (not shown) and a rifled bore 32. The barrel 16 is held securely to the upper receiver 20 by threaded engagement of the barrel nut portion 12 to the threaded attachment 18 of the receiver 20. Orientation of the barrel 16 is maintained in a well-known manner by a key pin 34 that engages a notch in the threaded portion 18. Thus, the barrel 16 is held against rotation as the barrel nut portion 12 is tightened onto the receiver 20. A forward tubular extension 36 of the barrel nut portion 12 may be spaced away from the barrel 16 to provide an annular first or primary chamber 38 substantially surrounding at least a portion of the barrel 16. The forward end of this primary chamber 38 may be closed by the coupling nut 24 that engages the threads 22 at the forward end of the barrel 16 and the internal annular shoulder 26. Again, the barrel 16 is restrained from rotation by the key pin 34 as the coupling nut 24 is threaded onto the barrel 16 and tensioned.

According to another feature of the invention, at least a pair of axially spaced-apart ports 40, 42 may be provided in the barrel 16 to provide fluid communication between the bore 32 and primary chamber 38. In the illustrated embodiment, the aft port 40 may be a series of radial openings, such as four openings circumferentially spaced at about 90 degrees from each other. Also in the illustrated embodiment, the forward port 42 may be a pair of radially extending, opposed openings. Thus, in the illustrated embodiment, the aft port 40 provides approximately twice the fluid communication of the forward port 42. The fluid communication can be controlled by the number and/or relative size of the openings comprising each port 40, 42. In the illustrated embodiment, these ports 40, 42 are positioned relatively aftwardly along the length of the bore 32 such that propulsion gases behind a projectile can vent into the primary chamber 38 before the projectile has left the bore 32 of the barrel 16. If desired, the length of the barrel 16, volume of the primary chamber 38, and position/size of the ports 40, 42 may be selected such that the cartridge propellant is substantially fully burned and propulsion gases fully expanded just as the projectile reaches the forward end of the bore 32 at the muzzle 43. These parameters may also be selected to cause the projectile velocity to remain subsonic, further reducing the resulting perceived sound level.

When a pressure wave passes along a closed end chamber, the pressure wave may be reflected back when it encounters the closed end of the chamber. Multiple pressure waves can interfere or resonate to produce a standing wave in such a chamber. The rapidly burning propellant from a firearm cartridge, however, typically acts as only a single pressure wave. Referring again to FIG. 4, as a pressure wave of expanding gasses enters the primary chamber 38 through the aft port 40, a pressure wave begins to travel forwardly through the annular primary chamber 38. Depending upon the duration of the pressure wave, it can be reflected back upon reaching the forward, closed end 47 of the primary chamber 38. It is believed that expanding gasses entering the chamber 38 through the forward port 42 can create a separate, and slightly delayed, pressure wave within the primary chamber 38, particularly if the expansion of propellant gases can be timed to end just as the projectile reaches a muzzle end 43 of the barrel 16. Interfering pressure waves in the primary chamber 38 can be sufficient to cause a momentary delay in evacuation of the high pressure propulsion gases from the chamber 38, back through the ports 40, 42, and into the bore 32. This momentary delay can be sufficient to allow a significant amount of energy to be consumed by heat transfer and turbulence caused by the reversal of flow, significantly reducing the perceived noise resulting from the pressure wave of the propellant blast.

Immediately forward of the coupling nut 24 can be a blast baffle 44. According to the illustrated embodiment, the blast baffle 44 includes an annular chamber 46 which, together with the tool socket 28 of the coupling nut 24, provides an expansion chamber immediately forward of the muzzle. The blast baffle 44 may include rearwardly oriented nozzle 45 with a central close passageway 48 that is axially aligned with the bore 32 of the barrel 16. This passageway 48 may have a diameter that is only slightly greater than that of the projectile, such that a relatively close clearance is provided while assuring no contact is made between the projectile and walls of the passageway 48. According to another aspect of the invention, the central passageway 48 may have an axial length equal to at least 0.75 times the length of a projectile expected to be used with the suppressor 10. If desired, the longitudinal length of the central passageway 48 may be from about 0.75 to about 2.5 times the length of the projectile to be used. By providing a relatively close fit and extended passageway length, the time required for the projectile to clear the central passageway 48 can be sufficient to allow significant expansion and corresponding reduction in pressure of the propellant gases escaping from the muzzle 43 and cause a momentary delay before the gases are free to flow through the central passageway 48.

As shown in FIGS. 2, 3, and 4, a series of baffles 50 may be provided forward of the blast baffle 44 along the remaining length of the forward tube 14. These baffles 50 and blast baffle 44 may be held in place by a threaded end cap 52 having a central passageway 54 axially aligned with the bore 32 of the barrel 16, the central passageway 48 of the blast baffle 44 and central openings in each of the forward baffles 50. Although the illustrated baffles 50 are what may be known as an "M-baffle," other baffle shapes (such as, but not limited to, K-baffles or cone baffles) may be used and the exact design and/or number of the forward baffles 50 is not essential to the present invention. In fact, the illustrated stack of twenty baffles 50 is likely to be greater in number than required to effectively suppress the sound of most center-fire, pistol caliber rounds, particularly at subsonic velocity. However, if the forward tube 14 is extended to provide a permanent overall barrel length greater than sixteen inches, there is no performance penalty, and relatively trivial added weight and cost, to filling the forward tube 14 with a full series of baffles 50.

Figure 5:
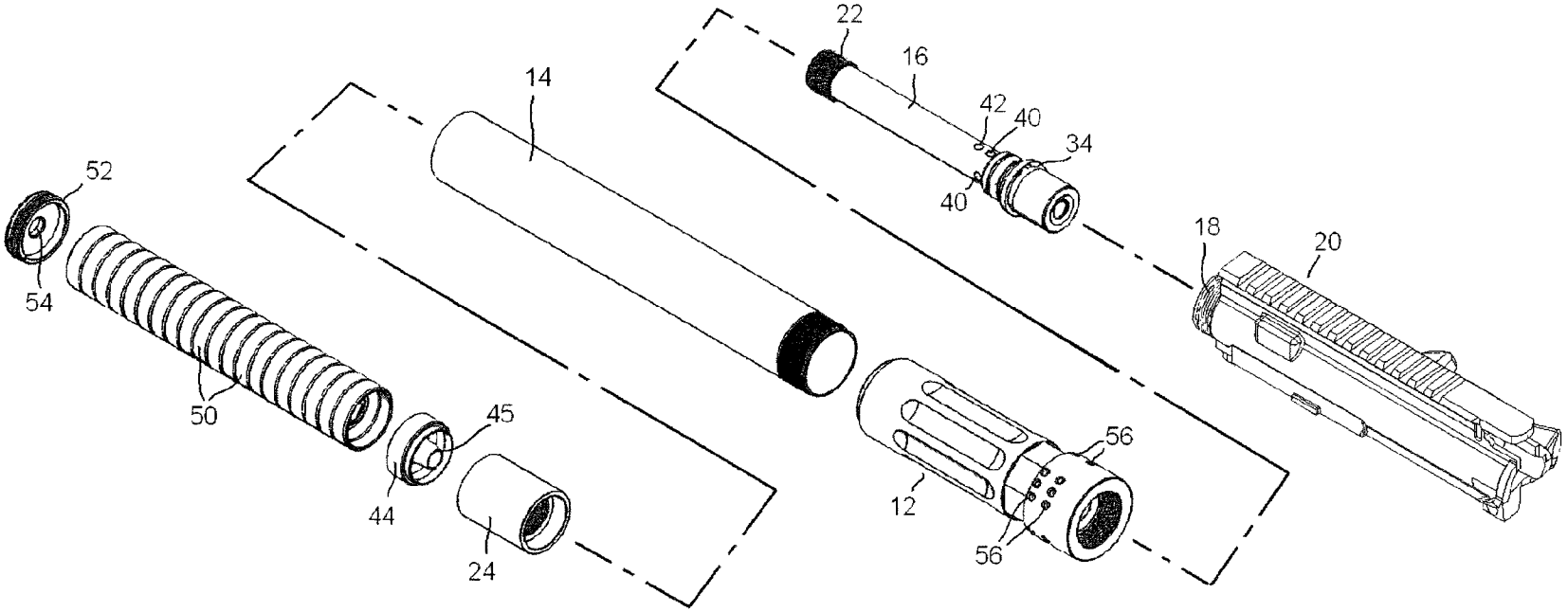
FIG. 5 is an isometric exploded view thereof.

Referring now in particular to FIGS. 1 and 5, the integral suppressor 10 may be assembled as follows:

The barrel nut portion 12 and forward tube 14 of the outer housing may be integrally formed, separable parts, or permanently fixed together, such as by welding, bonding, or locking a threaded engagement with a lock pin (not shown). The barrel 16 may be seated against the threaded attachment portion 18 of the upper receiver 20 and held in place by threading the barrel nut portion 12 onto the receiver 20. The coupling nut 24 may be inserted through the forward open end of the tube 14 and then rotated to threadingly engage exterior threads 22 at the forward end of the barrel 16. The coupling nut 24 may be rotated, such as with an elongated tool (not shown) inserted into the tube 14 into engagement with the non-round (such as hexagonal) tool socket 28. The coupling nut 24 can be threaded into place until it contacts the internal annular shoulder 26 and exerts a desired longitudinal tension on the barrel 16, holding the barrel 16 firmly in place and in alignment relative to the outer housing 12, 14. The blast baffle 44 and stack of sound suppression baffles 50 may then be inserted into the forward tube 14 and secured with the threaded end cap 52. If desired, a hand guard (not shown) may be installed over the suppressor 10, such as with fasteners that interface with threaded sockets 56 provided on an exterior surface of the barrel nut portion 12.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. An integral firearm sound suppressor, comprising:

a barrel having an axial bore, a chamber end, and a muzzle end, the chamber end attachable to a receiver by a barrel nut;

a first tube extending forwardly of the barrel nut to define an annular first chamber at least partially surrounding the barrel and having closed ends, the barrel having at least one port providing fluid communication between the bore and the first chamber;

an interior connector supporting the muzzle end of the barrel;

a baffle tube extending forwardly of the muzzle end of the barrel and having a forward end wall defining an exit opening; and at least one baffle positioned in the baffle tube and spaced forward of the muzzle end of the barrel.

2. The firearm sound suppressor of claim 1, wherein the connector defines a forward closed end of the first annular chamber.

3. The firearm sound suppressor of claim 1, further comprising a blast wall spaced forwardly from the muzzle end of the barrel and forming a blast chamber.

4. The firearm sound suppressor of claim 3, wherein the blast wall includes an elongated close passageway axially aligned with the bore and spaced forwardly from the muzzle end of the barrel, the close passageway having a diameter providing close clearance of a projectile to be fired and the length of the close passageway is at least 0.75 times length of projectile to be fired.

5. The firearm sound suppressor of claim 3, wherein the blast wall includes an elongated close passageway axially aligned with the bore and spaced forwardly from the muzzle end of the barrel, the close passageway having a diameter providing close clearance of a projectile to be fired and the length of the close passageway is in the range of about 0.75 to about 2.5 times length of projectile to be fired.

6. The firearm sound suppressor of claim 1, wherein the first tube is integral with or permanently affixed to the barrel nut.

7. The firearm sound suppressor of claim 1, wherein the baffle tube is integral with or permanently affixed to the first tube.

8. The firearm sound suppressor of claim 1, wherein the connector is threaded to the muzzle end of barrel.

9. The firearm sound suppressor of claim 8, further comprising an interior surface of the first tube having an internal shoulder against which the connector abuts when assembled, the barrel being placed in tension by tightening of the connector on the muzzle end of the barrel.

10. The firearm sound suppressor of claim 1, wherein the at least one port is positioned in a rearward portion of the first chamber.

11. The firearm sound suppressor of claim 1, comprising multiple, axially spaced apart ports.

12. The firearm sound suppressor of claim 11, wherein the multiple ports are positioned in a rearward portion of the first chamber.

* * * * *